US006158654A

United States Patent [19]

Zimmermann

[11] Patent Number: 6,158,654

[45] Date of Patent: Dec. 12, 2000

[54] CARTON WITH POUR SPOUT

[75] Inventor: John Zimmermann, Scarborough, Canada

[73] Assignee: Somerville Packaging Systems, Ontario, Canada

[21] Appl. No.: 09/252,890

[22] Filed: Feb. 19, 1999

[51] Int. Cl.[7] ..... B65D 5/74

[52] U.S. Cl. ..... 229/218; 229/217

[58] Field of Search ..... 229/217, 218, 229/219

[56] References Cited

U.S. PATENT DOCUMENTS

| | | | |
|---|---|---|---|
| 1,092,148 | 4/1914 | Jones | 229/219 |
| 2,028,687 | 1/1936 | Read | 229/218 |
| 2,095,720 | 10/1937 | Spalding | 229/218 |
| 2,349,362 | 5/1944 | Marshall | 229/218 |
| 2,570,982 | 10/1951 | Read | 229/218 |
| 3,037,679 | 6/1962 | Metzger | 229/219 |
| 5,082,117 | 1/1992 | Zimmermann | 219/218 |
| 5,711,479 | 1/1998 | Spronk | 229/218 |

FOREIGN PATENT DOCUMENTS

| | | | |
|---|---|---|---|
| 342137 | 1/1931 | United Kingdom | 229/218 |

OTHER PUBLICATIONS

Carton blank sample marked "STORA Gestel".

Carton blank sample marked "Farinsocker Sockerbolaget".

*Primary Examiner*—Gary E. Elkins

*Attorney, Agent, or Firm*—David P. Gordon; David S. Jacobson; Thomas A. Gallagher

[57] ABSTRACT

A carton blank has a generally half-circular line of perforation extending in the outer top panel and an end panel joined to the outer top panel at a hinge line. The line of perforation has a reduced radius portion which forms a lip in the assembled carton which acts as a closure for the spout. The end panel has an outside free edge not aligned with the main panel top edge so as to expose a portion of the inner top panel thereby allowing for joinder of the inner and outer top panels with fewer glue lines.

29 Claims, 8 Drawing Sheets

CARTON WITH POUR SPOUT

BACKGROUND OF THE INVENTION

This invention relates to a carton having a pour spout and to a carton blank suitable for forming such a carton.

U.S. Pat. No. 5,082,117 issued Jan. 21, 1992 naming me as inventor discloses a carton having a pour spout formed in one corner. The spout is formed by a half-circular line of perforation in the carton blank. In the blank, the line of perforation extends from a fold line between the inner top panel and the main panel, through a fold line between the inner top panel and an end panel, through a spout fold line in the end panel to a fold line between the end panel and a side panel. When the blank is assembled into a carton, the end panel folds about the spout fold line and is overlain by the inner top panel so as to form three overlapping panel sections, each with a portion of the line of perforation. The outer top panel then folds on top. The outer top panel has a corner cut out to expose all but an outer edge of the spout portion of the inner top panel. After the line of perforation is broken, the spout may be pulled open past the lip of the corner cut out in the outer top panel. The lip of the outer top panel thereafter acts as a closure for the spout.

SUMMARY OF THE INVENTION

In the subject invention, the carton blank has a generally half-circular line of perforation extending in the outer top panel and an end panel joined to the outer top panel at a hinge line. The line of perforation has a reduced radius section which forms a lip in the assembled carton which acts as a closure for the spout. The end panel has an outside free edge not aligned with the main panel top edge so as to expose a portion of the inner top panel thereby allowing for joinder of the inner and outer top panels with fewer glue lines.

Accordingly, the present invention provides a carton blank comprising: a main panel; a side panel hinged to said main panel at a fold line; a top panel hinged to said main panel at a fold line; an end panel hinged to a top edge of said side panel at a fold line and to a side edge of said top panel at a fold line, said end panel having a spout fold line extending from proximate a corner of said main panel to divide said end panel into a first spout panel proximate said side panel and a second spout panel proximate said top panel; a generally half-circular line of perforation extending from said fold line between said main panel and said top panel through said fold line between said top panel and said end panel, through said spout fold line to said fold line between said end panel and said side panel, said generally half-circular line of perforation having a reduced radius portion extending in at least one of said first spout panel, said second spout panel, and said top panel.

In one aspect the reduced radius portion of said line of perforation comprises a tangentially directed straight line portion of said generally half-circular line of perforation. In another aspect, the first spout panel has an outside edge extending from said side panel at an inclination toward said fold line between said end panel and said top panel. In a further aspect, the carton blank further comprises a depression in said top panel presented at a side of said top panel which will be directed inwardly after assembly into a carton, said depression extending from said generally half-circular line of perforation and from said fold line between said end panel and said top panel.

According to another aspect of the present invention, there is provided a carton blank comprising: a main panel; a side panel hinged to said main panel at a fold line; a top panel hinged to said main panel at a fold line; an end panel hinged to a top edge of said side panel at a fold line and to a side edge of said top panel at a fold line, said end panel having a spout fold line extending from proximate a corner of said main panel to divide said end panel into a first spout panel proximate said side panel and a second spout panel proximate said top panel; a line of perforation extending from said fold line between said main panel and said top panel through said fold line between said top panel and said end panel, through said spout fold line to said fold line between said end panel and said side panel; said first spout panel having an outside edge extending from said fold line between said side panel and said end panel at an inclination toward said fold line between said end panel and said top panel.

According to a further aspect of the invention, there is provided a carton, comprising: a main panel; a side panel; an inner top panel; an outer top panel; an intermediate first spout panel and an intermediate second spout panel joined together at a fold line and extending between said inner top panel and said outer top panel, said first spout panel joined to said side panel at a fold line and said second spout panel joined to said outer top panel at a fold line; a line of perforation extending from a top edge of said side panel along each of said first spout panel and second spout panel and along said outer top panel to a top edge of said main panel to define sections shaped generally as sectors of a circle between fold lines each centered at a corner where said side panel and said main panel meet; at least one section having a reduced radius portion.

According to another aspect, there is provided a carton, comprising: a main panel; a side panel; an inner top panel; an outer top panel; an intermediate first spout panel and an intermediate second spout panel joined together at a fold line and extending between said inner top panel and said outer top panel, said first spout panel joined to said side panel at a fold line and said second spout panel joined to said outer top panel at a fold line; a line of perforation extending from a top edge of said side panel along each of said first spout panel and second spout panel and along said outer top panel to a top edge of said main panel; said first spout panel having an outside free edge not aligned with said main panel top edge so as to expose a portion of said inner top panel.

BRIEF DESCRIPTION OF THE DRAWINGS

In the figures which illustrate example embodiments of the invention.

DETAILED DESCRIPTION OF THE PREFERRED EMBODIMENTS

Figure 1:
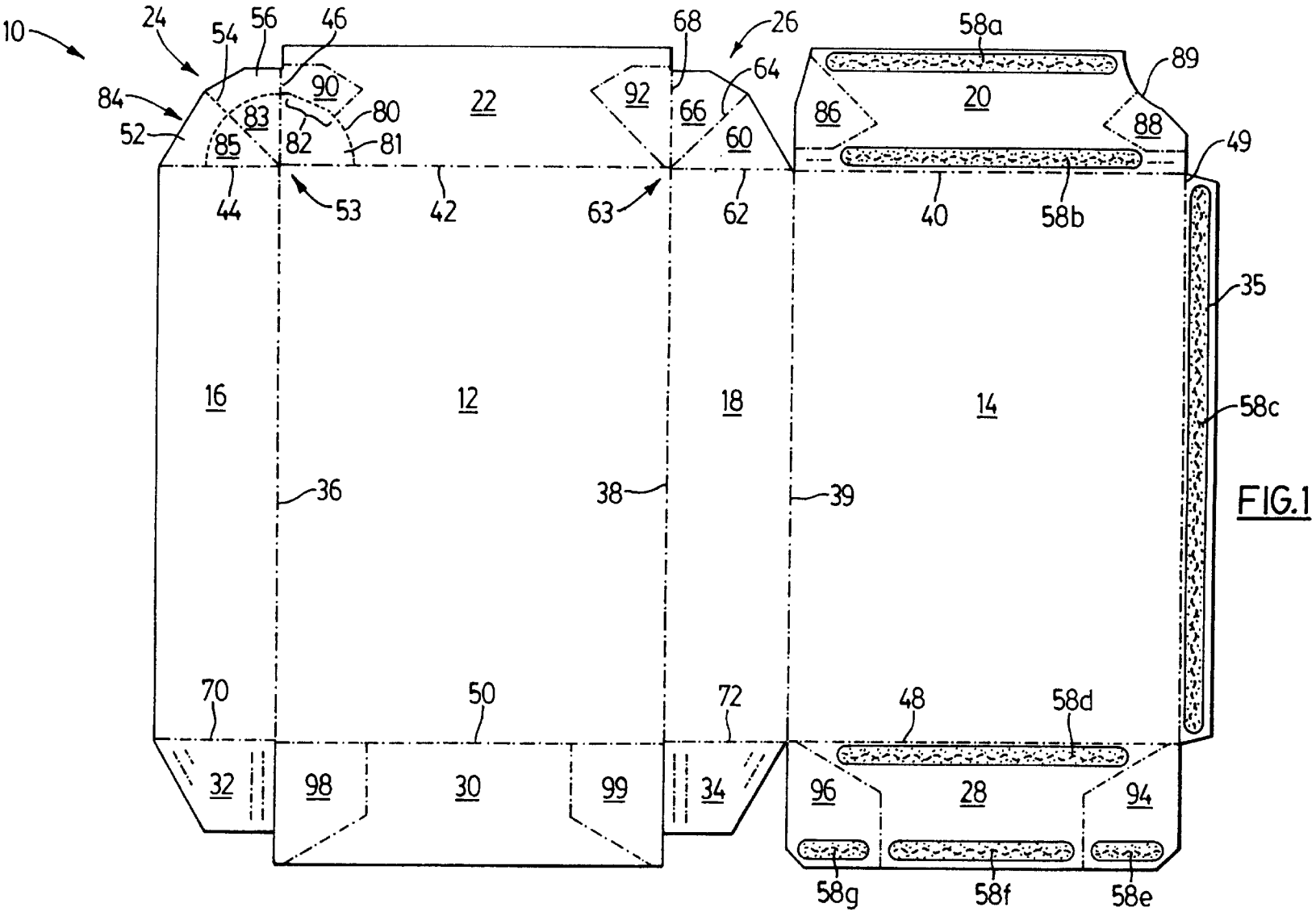
FIG. 1 is a plan view of a carton blank made in accordance with this invention.

Turning to FIG. 1, a carton blank 10 for a carton with a spout in one top corner has first and second main panels 12, 14, first and second side panels 16, 18, an inner top panel 20, an outer top panel 22, first and second top end panels 24, 26, an inner bottom panel 28, an outer bottom panel 30, first and second bottom end panels 32, 34, and a side flap 35.

The first main panel 12 is hinged to the first side panel 16, the second side panel 18, the top outer panel 22 and the bottom outer panel 30 along fold lines 36, 38, 42, and 50, respectively. The second main panel 14 is hinged to the second side panel 18, the inner top panel 20, the inner bottom panel 28, and the side flap 35 along fold lines 39, 40, 48, and 49, respectively.

The first top end panel 24 is divided by a spout fold line 54 extending from a corner 53 of main panel 12 into a first spout panel 52 proximate the first side panel 16 and a second spout panel 56 proximate the outer top panel 22. The second top end panel is divided into two sub-panels 60, 66 by a fold line 64 extending from a corner 63 of main panel 12. The first bottom panel 32 is hinged to the side panel 16 at a fold line 70 and the second bottom panel 34 is hinged to side panel 18 at a fold line 72.

A generally half-circular line of perforation 80 extends from the main panel top edge fold line 42 through the outer top panel side edge fold line 46 and through the spout fold line 54 to the side panel top edge fold line 44. This generally half-circular line of perforation has a reduced radius portion 82 extending in the outer top panel 22. This reduced radius portion is a linear portion extending tangentially with respect to the generally half-circular line of perforation 80 and, in length, is about one-half the length of the line of perforation 80 in the outer top panel 22. It will be noted that the spout fold line 54 extends radially with respect to the generally half-circular line of perforation 80. Thus, the line of perforation 80 defines a section 81 between fold lines 42 and 46 shaped generally as a sector of a circle, another section 83 between fold lines 46 and 54 shaped as a sector of a circle and a further section 85 between fold lines 54 and 44 shaped as a sector of a circle.

The outside edge 84 of the first spout panel 52 extends from the side panel 16 at an inclination toward the fold line 46 between the end panel 24 and the top panel 22. Similarly, the outside edge 85 of sub-panel 60 extends from the side panel 18 at an inclination toward the fold line 68 between the end panel 26 and the top panel 22.

The inner top panel 20 has depressions 86 and 88 therein; outer top panel 22 has embossments 90, 92 thereon which are formed by depressions in the opposite side of the outer top panel 22; inner bottom panel 30 has depressions 94, 96 therein and outer bottom panel 28 has embossments 98, 99 thereon which are formed by depressions in the opposite side of the outer bottom panel 28.

The inner top panel 20 narrows toward its free top edge at a side edge 89 adjacent depression 88.

Prior to assembly of the blank into a carton, glue lines 58*a* and 58*b* are applied to inner top panel 20, glue line 58*c* is applied to flap 35, and glue lines 58*d*, 58*e*, 58*f*, 58*g* are applied to inner bottom panel 28.

Figure 2:
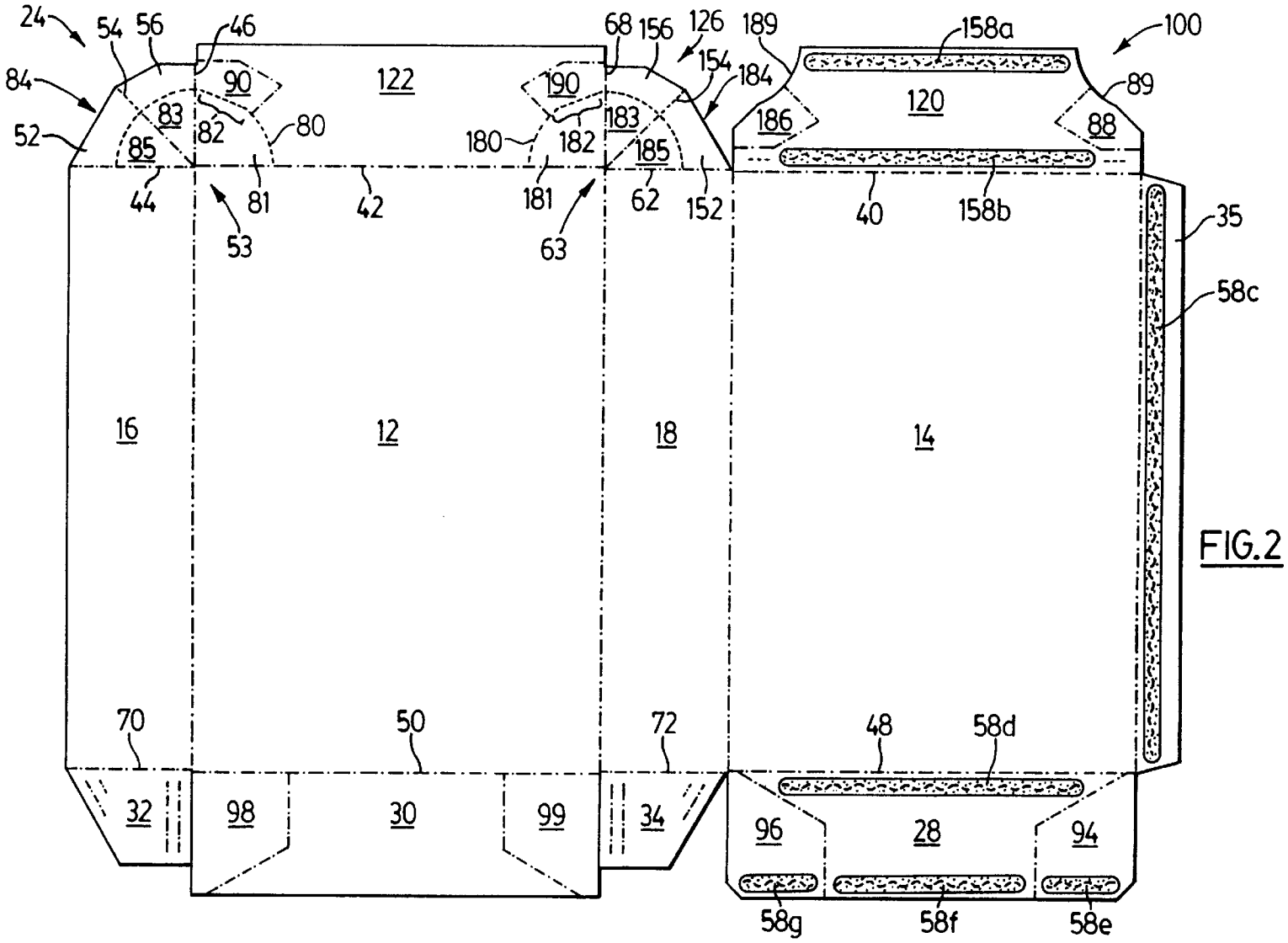
FIG. 2 is a plan view of a carton blank made in accordance with another aspect of this invention.

FIG. 2 illustrates a carton blank 100 for a carton with a spout in opposite top corners. In the carton blank of FIG. 2, like parts to those of the blank 10 of FIG. 1 are given like reference numerals. Carton blank 100 differs from blank 10 of FIG. 1, as follows. Second top end panel 126 is divided by a spout fold line 154 extending from a corner 63 of main panel 12 into a third spout panel 152 proximate the second side panel 18 and a fourth spout panel 156 proximate the outer top panel 122. A generally half-circular line of perforation 180 extends from the main panel top edge fold line 42 through the outer top panel side edge fold line 68 and through the spout fold line 154 to the second side panel top edge fold line 62. This generally half-circular line of perforation has a reduced radius portion 182 extending in the outer top panel 122. This reduced radius portion is a linear portion extending tangentially with respect to the generally half-circular line of perforation 180 and, in length, is about one-half the length of the line of perforation 180 in the outer top panel 122. It will be noted that the spout fold line 154 extends radially with respect to the generally half-circular line of perforation 180. Thus, the line of perforation 180 defines a section 181 between fold lines 42 and 68 shaped generally as a sector of a circle, another section 183 between fold lines 68 and 154 shaped as a sector of a circle and a further section 185 between fold lines 154 and 63 shaped as a sector of a circle.

The outside edge 184 of the third spout panel 152 extends from the side panel 18 at an inclination toward the fold line 68 between the end panel 126 and the top panel 122.

Inside top panel 120 has a depression 186 therein and a narrowing toward its top edge at side 189. Outside top panel 122 has a embossment 190 thereon. It will be apparent that the top end panels 24, 126 are mirror images of each other. Further, the top panels 120, 122 present mirror images about notional vertical lines which bisect each such panel.

Because of the differences in inner top panel 120 as compared with inner top panel 20 of FIG. 1, glue lines 158*a*, 158*b* applied to panel 120 are of a different length than glue lines 58*a*, 58*b* of FIG. 1.

Carton blank 10 of FIG. 1 and 100 of FIG. 2 may be fabricated of card stock or any other suitable flexible material.

Figure 3:
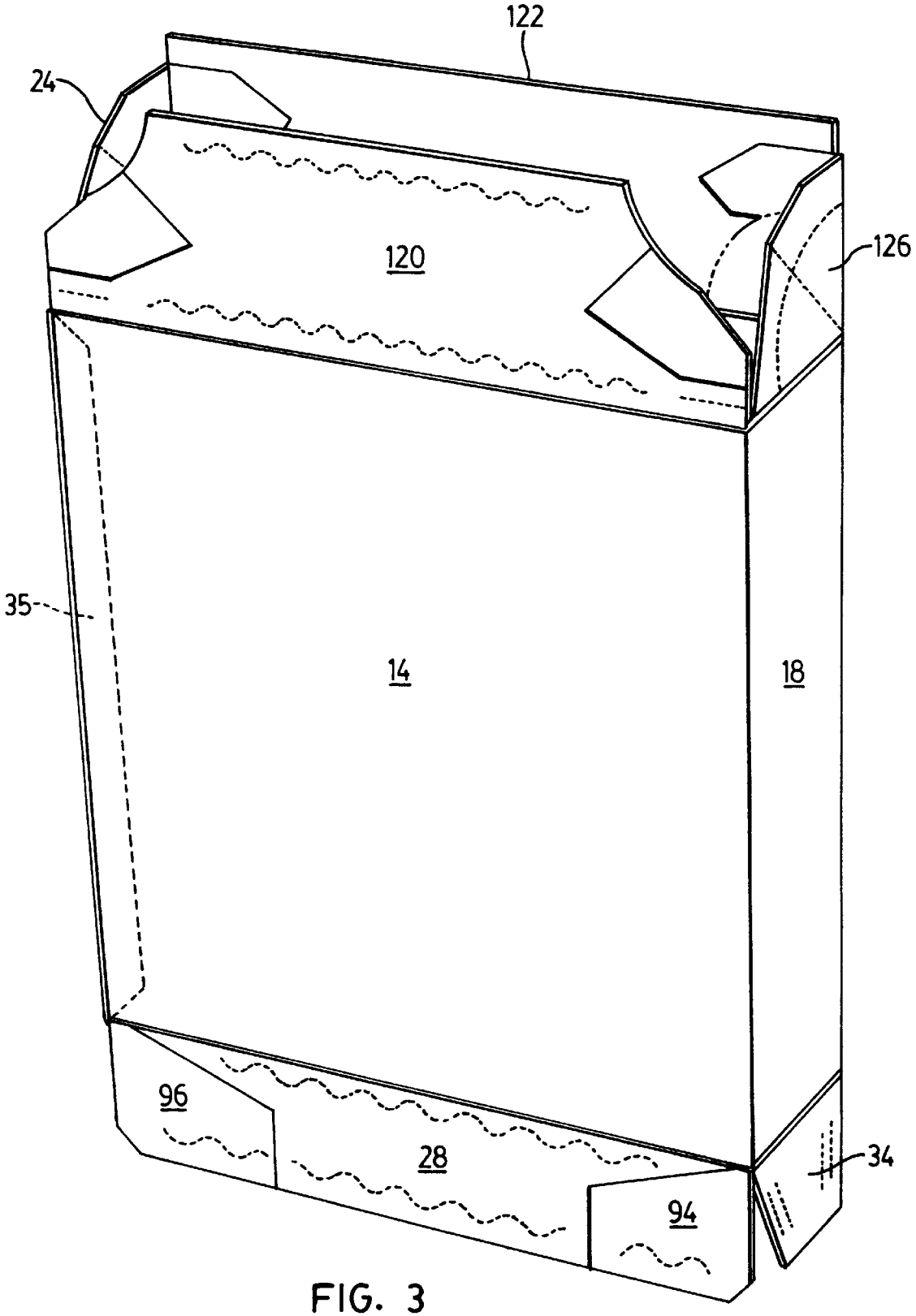
FIG. 3 is a perspective view of the carton blank of FIG. 2 partially assembled into a carton.

The assembly of carton blank 100 into a carton is illustrated in FIGS. 3 through 6. Turning to FIG. 3, after application of the glue line 58*c* (FIG. 2), the carton blank may be folded into the sleeve configuration illustrated in FIG. 3 with flap 35 adhered to the inside surface of side panel 16 (FIG. 2). After application of glue lines 58*d*, 58*e*, 58*f*, 58*g* (FIG. 2), inner bottom panel 28 is folded in, then bottom end flaps 32 (FIG. 2), 34 and, lastly, outer bottom panel 30 (FIG. 2). The outer bottom panel 30 and end flaps 32, 34 are adhered to the inner bottom panel 28 by the glue lines 58*d*, 58*e*, 58*f*, 58*g*. Depressions 94, 96 in the inner bottom panel and the embossments 98, 99 (FIG. 2) in the outer bottom panel 30 (which present depressions toward the inside of the sleeve) co-operate to allow the bottom end flaps 32, 34 to be sandwiched between the inner and outer bottom panels 28, 30 with minimal increase in thickness beyond that of the two-ply thickness elsewhere provided by the inner and outer bottom panels 28, 30.

Figure 4:
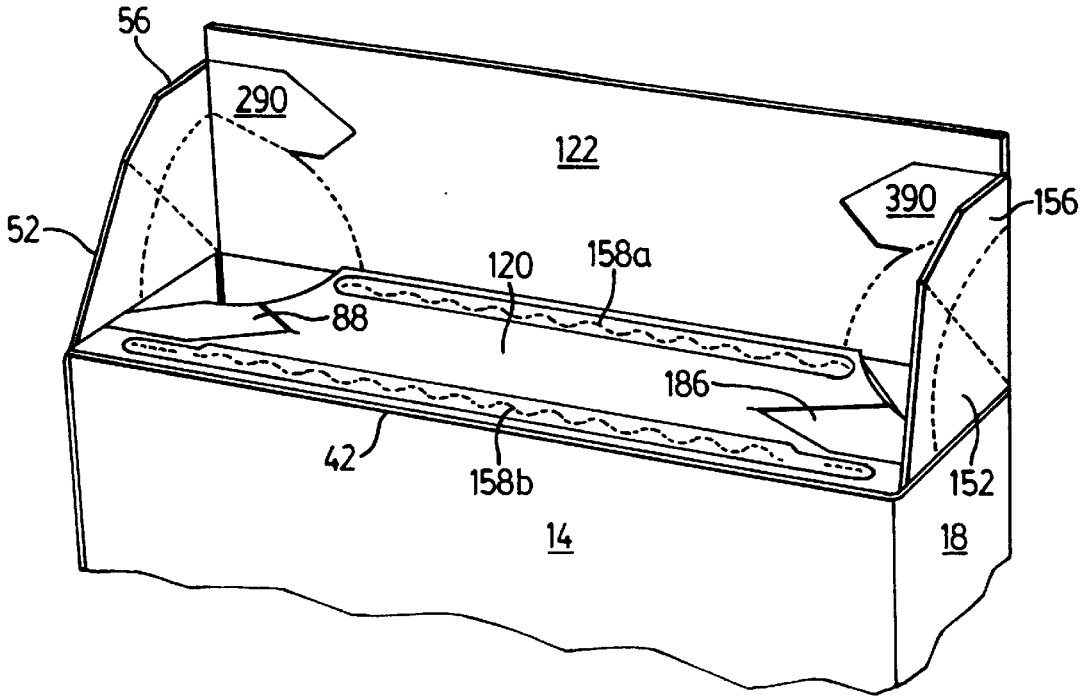
FIGS. 4, 5, and 6 are perspective fragmentary views illustrating assembly of a carton from the blank of FIG. 2, FIGS. 7, 8, 9, and 10 are perspective fragmentary views illustrating the opening and re-closing of the spout in the carton of FIG. 6.

Referencing FIG. 4, after application of glue lines 158*a*, 158*b*, the inner top panel 120 is folded inwardly. Next, turning to FIG. 5, the outer top panel 122 is folded inwardly as the spout fold lines 54, 154 are urged to collapse inwardly. When the top outer panel 122 is fully folded, it adheres to the top inner panel 120, as illustrated in FIG. 6 thereby forming the completed carton 200. The embossments 90, 190 (FIG. 2) in the outer top panel 122 present depressions 290, 390 (FIG. 4) to the interior of the carton. These depressions 290, 390 co-operate with the depressions 88, 186 (FIG. 4) in the inner top panel 120 to allow the spout panels 52, 54, 152, 154 (FIG. 4) to be sandwiched between the inner and outer top panels 120, 122 with minimal increase in thickness beyond that of the two-ply thickness elsewhere provided by the inner and outer top panels 120, 122.

Figure 5:
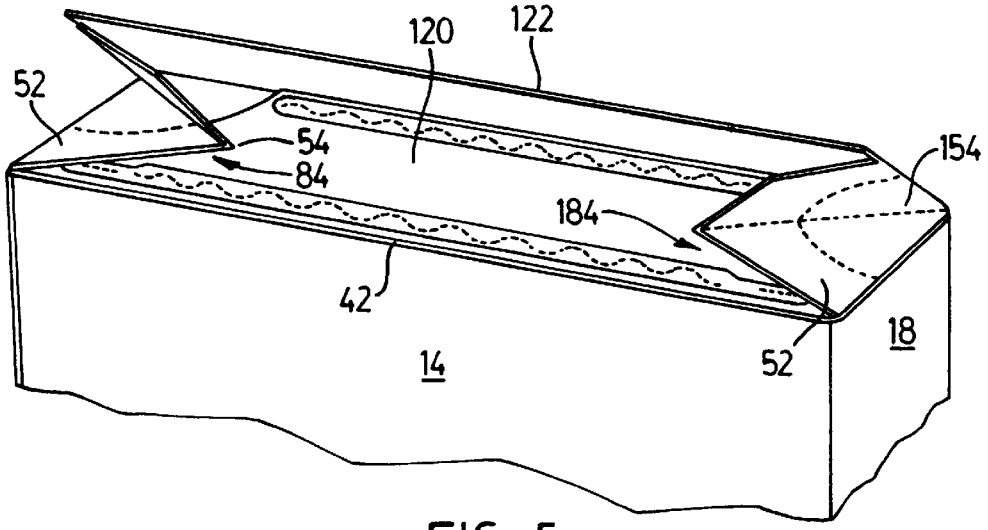
Figure 6:
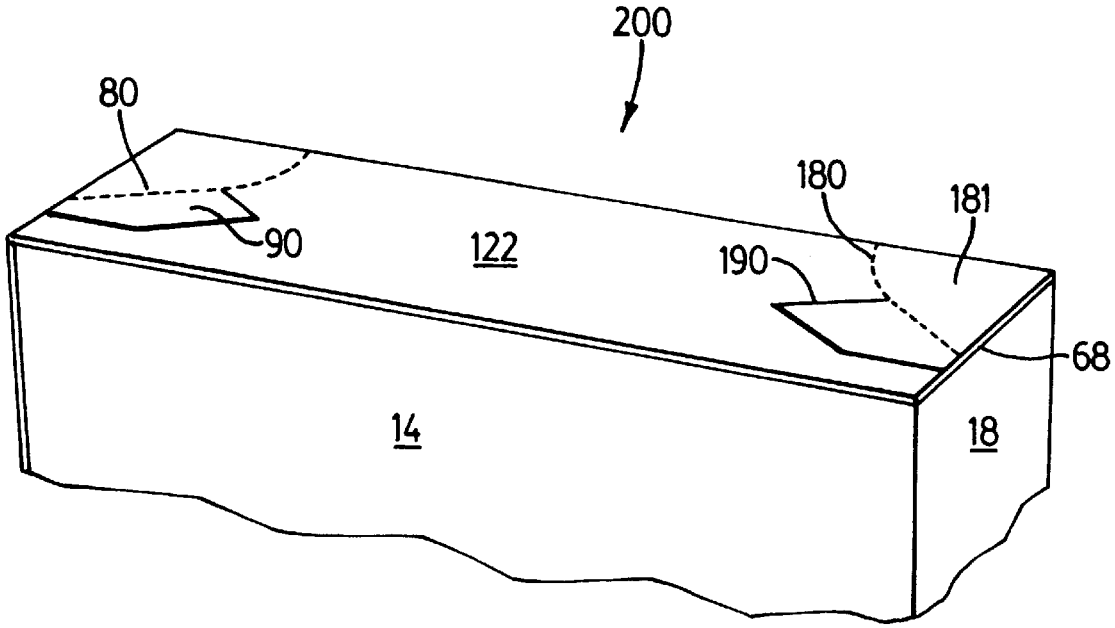

Referencing FIG. 5, it will be noted that the inclination of the outside edge 84 of the first spout panel 52 and of the outside edge 184 of the third spout panel 152 expose a portion of the base of the inner top panel 120 to the outer top panel 122. Were the outside edges 84, 184 instead aligned with the top edge fold line 42, a separate glue line on spout panels 52, 152 would be required to secure the ends of the inner top panel.

The assembly of carton blank 10 of FIG. 1 into a carton follows the same steps as described in conjunction with carton blank 100 (with reference to spout fold line 154 of FIG. 2 being read as a reference to fold line 64 of FIG. 1, reference to spout panels 152, 156 of FIG. 2 being read as a reference to sub-panels 60, 66, respectively, of FIG. 1, and reference to embossment 190 of FIG. 2 being read as a reference to embossment 92 of FIG. 1).

Figure 7:
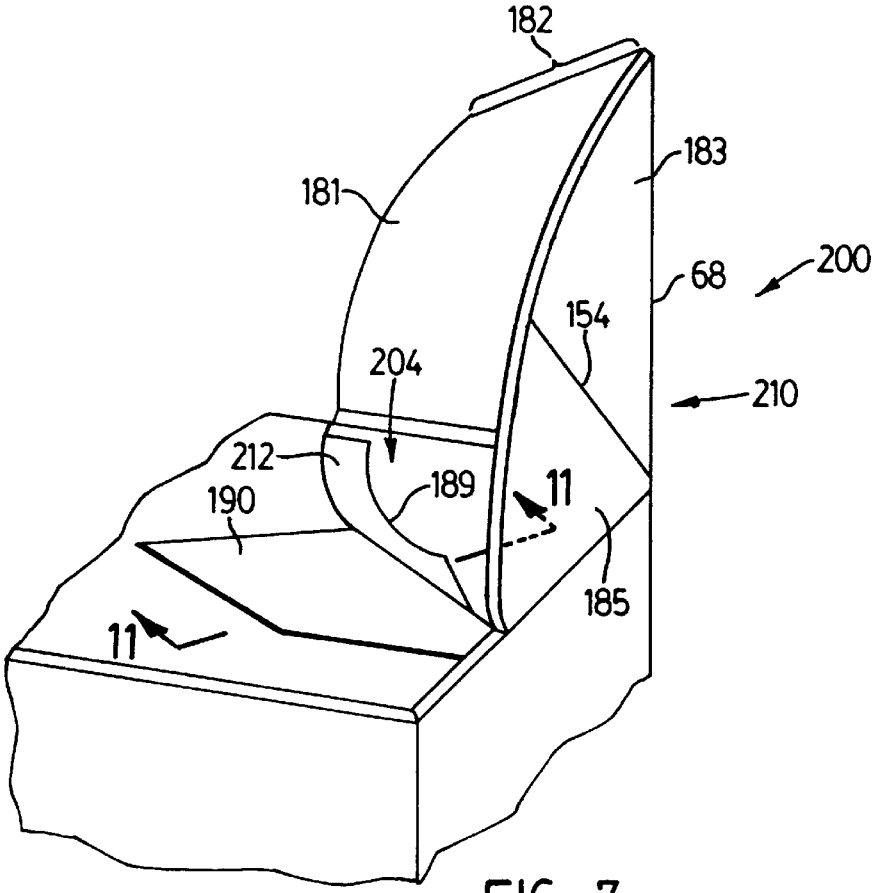
Figure 11:
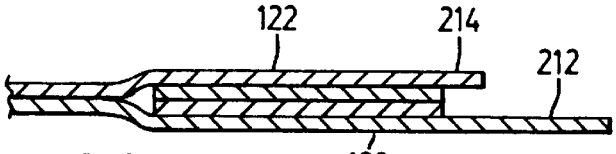
FIG. 11 is a view along the lines 11—11 of FIG. 7.

After assembly of carton blank 100 into a carton 200, a spout may be opened in the carton, as follows. Referencing FIG. 6, line of perforation 180 may be broken and then section 181 grasped at fold line 68 and drawn upwardly. Referencing FIG. 7, this causes a spout 210 to unfold. It will be noted that the narrowing of the inner top panel 120 at edge 189 defines an opening 204 from the interior of the carton 200 to the spout 210. Referencing FIG. 11 along with FIG. 7, it will also be noted that the inner top panel 120 defines a ledge 212 and that the outer top panel 122 defines a lip 214. Lip 214 results from the straight line portion 182 of the line of perforation 180 which reduces the radius of a portion of section 181 as compared with sections 183, 185.

Figure 8:
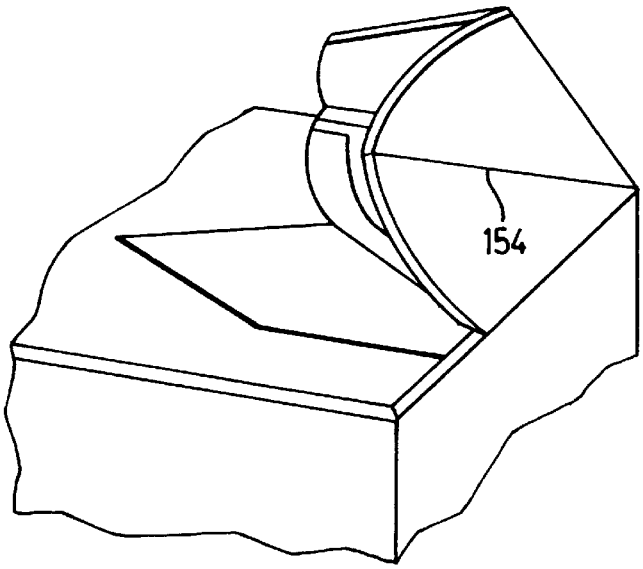
Figure 9:
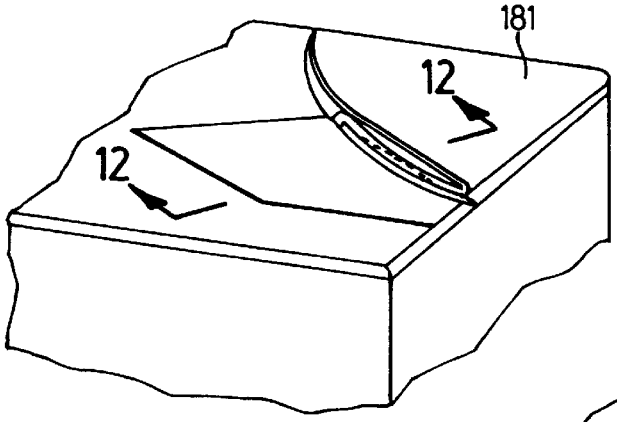
Figure 10:
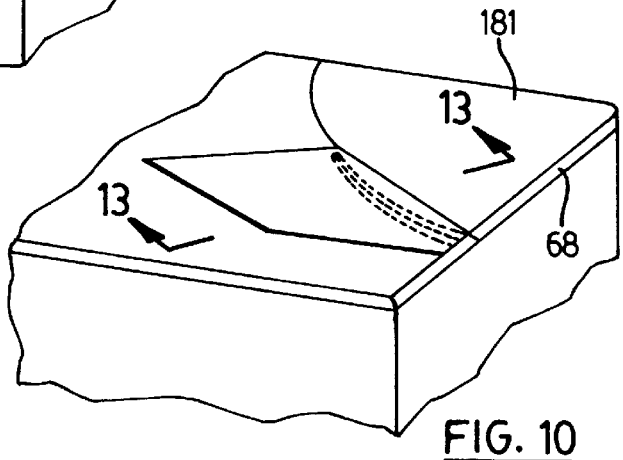
Figure 12:
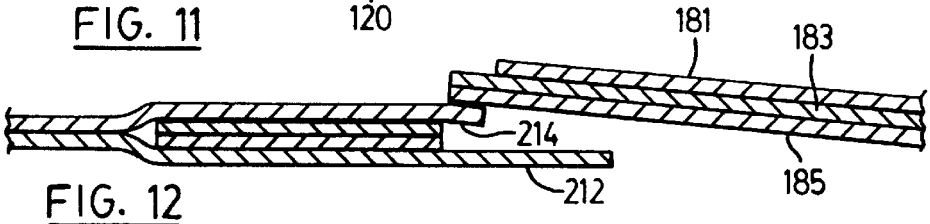
FIG. 12 is a view along the lines 12—12 of FIG. 9.
Figure 13:
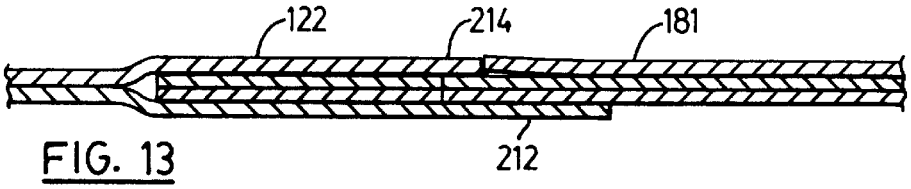
FIG. 13 is a view along the lines 13—13 of FIG. 10.

Once opened, the spout 210 may be re-closed by first urging the spout fold line 154 to collapse inwardly, as illustrated in FIG. 8. As the sections 181, 183, 185 are folded down, section 185 will contact lip 214 of outer top panel 122, as illustrated in FIGS. 9 and 12. Further pressure on the top of section 181 will cause sections 183, 185 to snap under lip 214 to rest on ledge 212 of inner top panel 122. In this position, the spout is latched in its closed position, as illustrated in FIGS. 10 and 13.

After being re-closed, the spout may again be opened by again grasping section 181 at fold line 68 and drawing upwardly.

Figure 14:
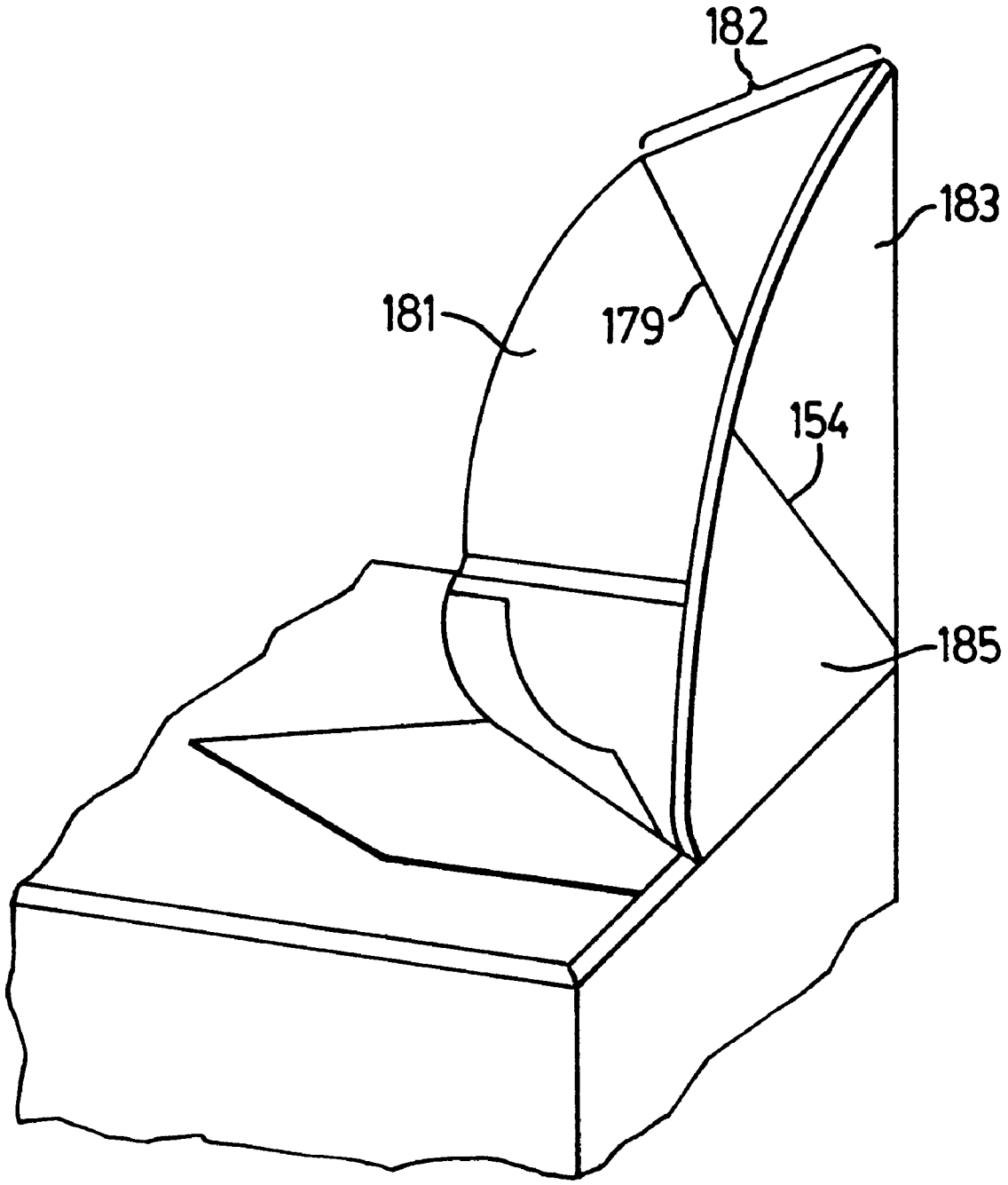
FIG. 14 is a perspective fragmentary view of a carton made in accordance with another aspect of this invention.

When open, the spout has a tendency to collapse around spout fold line 154. Referencing FIG. 2, to avoid this problem, the carton blank 24 may be provided with an additional spout fold line which radially extends from corner 63 to perforation line 180 in section 181 proximate an end of straight line portion 182. A similar additional spout fold line may be provided in the first top end panel 24. Turning to FIG. 14, this additional spout fold line 179 increases the symmetry of the spout and therefore counter-balances the self-collapsing effect of spout fold line 154.

Referencing FIG. 6, at the election of the user, instead of breaking perforation line 180, perforation line 80 may be broken in order to open a re-closable spout at the opposite side of the carton 200. The spout of a carton formed from blank 10 may be similarly opened and re-closed.

While not preferred, the straight line portion of the line of perforation 180 could extend in section 183 in addition to, or instead of, section 181. Also, if ledge 212 were sufficiently flexible, or omitted, the straight line portion of the line of perforation 180 could extend in section 185 or sections 183 and 185 instead of section 181. However, any of these options may result in a spout which will not re-close as tightly or as well as the spout illustrated. Also, instead of a straight line portion in the line of perforation, other shapes which provide a reduced radius section in the line of perforation are possible, such as a concavely curved portion.

Other modifications within the spirit of this invention will be apparent to those skilled in the art.

What is claimed is:

1. A carton blank comprising:

a main panel;

a side panel hinged to said main panel at a fold line;

a top panel hinged to said main panel at a fold line;

an end panel hinged to a top edge of said side panel at a fold line and to a side edge of said top panel at a fold line, said end panel having a spout fold line extending from proximate a corner of said main panel to divide said end panel into a first spout panel proximate said side panel and a second snout panel proximate said top panel;

a generally half-circular line of perforation extending from said fold line between said main panel and said top panel through said fold line between sad top panel and said end panel, through said spout fold line to said fold line between said end panel and said side panel, said generally half-circular line of perforation having a reduced radius portion extending in at least one of said first spout panel, said second spout panel, and said top panel wherein said reduced radius portion of said line of perforation comprises a tangentially directed straight line portion of said generally half-circular line of perforation.

2. The carton blank of claim 1 wherein said tangentially directed straight line portion extends in said top panel and not in said first spout panel nor in said second spout panel.

3. The carton blank of claim 1 wherein said tangentially directed straight line portion extends along approximately one-half a length of said line of perforation in said top panel.

4. The carton blank of claim 1 wherein said main panel is a first main panel and said top panel is a first top panel and further comprising:

a second main panel hinged to said side panel;

a second top panel hinged to said second main panel, said second top panel narrowing toward its top edge at a side edge which, at least after assembly into a carton, is proximate said first spout panel, said second top panel having a depression therein extending from said second top panel side edge.

5. The carton blank of claim 1 wherein said spout panel fold line is linear and extends radially with respect to said generally half-circular line of perforation.

6. The carton blank of claim 5 wherein said main panel, said side panel, and said top panel are rectangular.

7. The carton blank of claim 1 wherein said side panel is a first side panel and further comprising:

a second side panel hinged to said main panel at a fold line;

a second end panel hinged to a top edge of said second side panel at a fold line and to a second side edge of said top panel at a fold line, said second end panel having a spout fold line extending from proximate a corner of said main panel to divide said second end panel into a third spout panel proximate said second side panel and a fourth spout panel proximate said top panel;

a generally half-circular line of perforation extending from said fold line between said main panel and said top panel through said fold line between said top panel and said second end panel, through said second end panel spout fold line to said fold line between said second end panel and said second side panel, said generally half-circular line of perforation having a reduced radius portion extending in at least one of said third spout panel, said fourth spout panel, and said top panel.

8. The carton blank of claim 1 further comprising a further spout fold line, said further spout fold line extending from proximate a corner of said main panel to said generally half-circular line of perforation in said top panel.

9. A carton blank comprising:

a main panel;

a side panel hinged to said main panel at a fold line;

a top panel hinged to said main panel at a fold line;

an end panel hinged to a top edge of said side panel at a fold line and to a side edge of said top panel at a fold line, said end panel having a spout fold line extending from proximate a corner of said main panel to divide said end panel into a first spout panel proximate said side panel and a second spout panel proximate said too panel;

a generally half-circular line of perforation extending from said fold line between said main panel and said top panel through said fold line between said top panel and said end panel, through said spot fold line to said fold line between said end panel and said side panel, said generally half-circular line of perforation having a reduced radius portion extending in at least one of said first spout panel, said second spout panel, and said top panel wherein said fist spout panel has an outside edge extending from said side panel at an inclination toward said fold line between said end panel and said top panel.

10. A carton blank comprising:

a main panel;

a side panel hinged to said main panel at a fold line;

a top panel hinged to said main panel at a fold line;

an end panel hinged to a top edge of said side panel at a fold line and to a side edge of said top panel at a fold line, said end panel having a spout fold line extending from proximate a corner of said main panel to divide said end panel into a first spout panel proximate said side panel and a second spout panel proximate said top panel;

a generally half-circular line of perforation extending from said fold line between said main panel and said top panel through said fold line between said top panel and said end panel, through said spout fold line to said fold line between said end panel and said side panel, said generally half-circular line of perforation having a reduced radius portion extending in at least one of said first spout panel, said second spout panel, and said top panel further comprising a depression in said top panel presented at a side of said top panel which will be directed inwardly after assembly into a carton, said depression extending from said generally half-circular line of perforation and from said fold line between said end panel and said top panel.

11. The carton blank of claim 10 wherein said first spout panel makes a triangular shape and has an outside edge and wherein an angle inside said triangular shape between said outside edge and said fold line between said side panel and said end panel is an acute angle.

12. The carton blank of claim 11 wherein each fold line is linear.

13. A carton blank comprising:

a main panel;

a side panel hinged to said main panel at a fold line;

a top panel hinged to said main panel at a fold line;

an end panel hinged to a top edge of said side panel at a fold line and to a side edge of said top panel at a fold line, said end panel having a spout fold line extending from proximate a corner of said main panel to divide said end panel into a first spout panel proximate said side panel and a second spout panel proximate said top panel;

a line of perforation extending from said fold line between said main panel and said top panel through said fold line between said top panel and said end panel, through said spout fold line to said fold line between said end panel and said side panel;

said first spout panel having an outside edge extending from said fold line between said side panel and said end panel at an inclination toward said fold line between said end panel and said top panel.

14. A carton, comprising:

a main panel;

a side panel;

an inner top panel;

an outer top panel;

an intermediate first spout panel and an intermediate second spout panel joined together at a spout fold line and extending between said inner top panel and said outer top panel, said first spout panel joined to said side panel at a fold line and said second spout panel joined to said outer top panel at a fold line;

a line of perforation extending from a top edge of said side panel along each of said first spout panel and second spout panel and along said outer top panel to a top edge of said main panel to define sections shaped generally as sectors of a circle between fold lines each centered at a corner where said side panel and said main panel meet;

at least one section having a reduced radius portion.

15. The carton of claim 14 wherein said reduced radius portion of said at least one section is defined by a linear portion of said line of perforation.

16. The carton of claim 15 wherein said linear portion is tangentially directed with respect to an arc of said at least one section.

17. The carton of claim 15 wherein said at least one section comprises a section in said outer top panel.

18. The carton of claim 15 wherein said linear portion comprises about one-half a length of said line of perforation in said outer top panel.

19. The carton of claim 14 wherein said first spout panel has an outside free edge not aligned with said main panel top edge so as to expose a portion of said inner top panel.

20. The carton of claim 19 wherein said first spout panel outside free edge extends at an angle to said main panel top edge to expose said portion of said inner top panel.

21. The carton of claim 20 wherein said inner panel narrows toward a free edge opposite a fold line between said main panel and said inner panel at a side edge proximate said first spout panel and said second spout panel to form an opening, said sections generally overlying said opening.

22. The carton of claim 21 wherein said sections proximate said line of perforation overlie said inner panel.

23. The carton of claim 21 including a depression in said inner top panel receiving a portion of said first spout panel beyond a section of said first spout panel.

24. The carton of claim 22 including a depression in said outer top panel receiving a portion of said second spout panel beyond a section of said second spout panel.

25. The carton of claim 20 including a glue line extending along said inner top panel including said exposed portion of said inner top panel.

26. The carton of claim 14 including a further spout fold line, said further spout fold line extending in said outer top panel from a corner of said outer top panel to said line of perforation.

27. The carton of claim 14 wherein said inner top panel extends underneath said intermediate first spout panel and said intermediate second spout panel thereby supporting said intermediate first spout panel and said intermediate second spout panel.

28. A carton, comprising:

a main panel;

a side panel;

an inner top panel;

an outer top panel;

an intermediate first spout panel and an intermediate second spout panel joined together at a fold line and extending between said inner top panel and said outer top panel, said first spout panel joined to said side panel at a fold line and said second spout panel joined to said outer top panel at a fold line;

a line of perforation extending from a top edge of said side panel along each of said first spout panel and second spout panel and along said outer top panel to a top edge of said main panel;

said first spout panel having an outside free edge not aligned with said main panel top edge so as to expose a portion of said inner top panel.

29. The carton of claim 28 wherein said first spout panel outside free edge extends at an angle to said main panel top edge to expose said portion of said inner top panel.

* * * * *

UNITED STATES PATENT AND TRADEMARK OFFICE

CERTIFICATE OF CORRECTION

PATENT NO. : 6,158,654
DATED : December 12, 2000
INVENTOR(S) : Zimmermann, John

It is certified that error appears in the above-identified patent and that said Letters Patent is hereby corrected as shown below:

Claim 1, column 6,
Line 14, delete 'snout" and insert -- spout --;
Line 18, delete "sad" and insert -- said --;

Claim 9, column 7,
Line 19, delete "too" and insert -- top --;
Line 24, delete "spot" and insert -- spout --; and
Line 29, delete "fist" and insert -- first --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*